United States Patent [19]

Boomer

[11] Patent Number: 4,538,809

[45] Date of Patent: Sep. 3, 1985

[54] MECHANICAL BRIDGE AND CHALK HOLDER

[76] Inventor: Wayne Boomer, 3407 Spenard Rd. #1, Anchorage, Ak. 99503

[21] Appl. No.: 557,616

[22] Filed: Dec. 2, 1983

[51] Int. Cl.[3] ..... A63D 15/00

[52] U.S. Cl. ..... 273/18; 273/23

[58] Field of Search ..... 273/17, 18, 23, 19, 273/20, 21, 14; 446/85

[56] References Cited

U.S. PATENT DOCUMENTS

| | | | |
|---|---|---|---|
| 744,935 | 11/1903 | Pejchar | 273/18 |
| 2,817,525 | 12/1957 | Niemam | 273/23 |
| 3,420,527 | 1/1969 | Morin | 446/85 |
| 4,060,243 | 11/1977 | Langan | 273/18 |

FOREIGN PATENT DOCUMENTS

| | | | |
|---|---|---|---|
| 646539 | 11/1928 | France | 273/17 |
| 300988 | 10/1929 | United Kingdom | 273/18 |
| 310888 | 8/1930 | United Kingdom | 273/18 |

*Primary Examiner*—Richard C. Pinkham
*Assistant Examiner*—T. Brown
*Attorney, Agent, or Firm*—Michael J. Tavella

[57] ABSTRACT

An improved mechanical bridge and chalk holder is disclosed which improves the play of pool, pocket billards and billards. The device comprises a block portion that has a curved bridge portion with one or more grooves cut transversely to provide support for a cue stick. A notch is also provided at one end which allows the bridge to be used in a verticle position for "over the ball" shots. Also disclosed is a cylindrical chalk holder attached to the opposite end of the bridge from the notch. The chalk holder is provided with hole for the removal of spent chalk.

8 Claims, 5 Drawing Figures

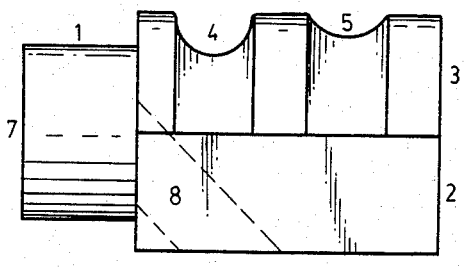
FIG. I.
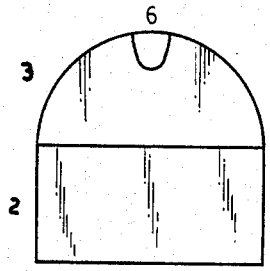
FIG. II.
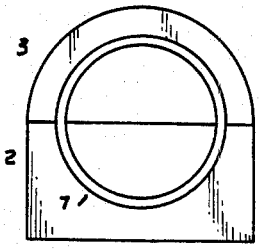
FIG. III.
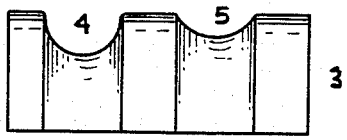
FIG. IV.
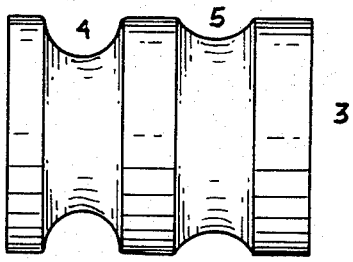
FIG. V.

MECHANICAL BRIDGE AND CHALK HOLDER

BACKGROUND OF THE INVENTION

This invention is related to mechanical bridges, supports for cue sticks, and cue chalk holders.

The games of pool, pocket billards and billards require many skills. One needed skill is the ability to support the cue so that an accurate shot can be made. Generally, most players use their hand to form a "bridge" around the cue. While this method has been around for some time, it has some difficulties. First, the player must spend many hours practicing the proper positioning of the hand to allow for the many types of shots found in a typical game. Second, the hand tends to perspire which decreases the friction on the cue. Cue glide wax or baby powder can be applied to the hand to smooth out the action of the stick. This is usually messy and can soil clothing. Further, conditions can change which require the removal of the baby powder, making it very inconvenient to use. Finally, there are many shots made during a game that require reaching across the billard table. These shots cannot be made without some sort of assistance.

Another problem that this invention addresses is related to means of conveniently storing cue chalk for use during a game. Typically, chalk is placed around the playing table where it is often in the way of the shooter. Also, it will usually be knocked to the floor at some point in the game. Many different types of devices have been invented that address these concerns. U.S. Pat. No. 62,827 to Dolan and U.S. Pat. No. 1,227,312 to Rear disclose devices that overcome the problem of reaching excessively across the table. Rear shows a simple X-type support that is attached to the end of a stick. Thus, the player can position the holder to the proper place on the table and, by placing the cue in the crotch of the X, can make the shot. The X-type design, however, is rather limited in the control of the cue. The Dolan Patent improves on this design by providing rollers in the top structure of the bridge to support the cue. Additional rollers, to allow for different shooting angles, are also provided. The rollers, plus the rectangular shape, which gives extra height for the cue by placing the invention on one end, gives this bridge a number of advantages over the simple "X" frame design. While both of these devices improve the performance of the game, their use is limited primarily to the occational extend reach shots. Further, while Dolan makes some allowance for height and angle differences, neither device has enough angular combinations to provide expert control.

Another invention, U.S. Pat. No. 437,746, addresses the problem of chalk storage. This device is a chalk holder, mounted on the butt end of a cue stick. This device has two inherent problems, however. First, to use the device, the player must change the position of the cue by reaching around to the butt to remove the chalk, sliding the cue stick down to reach the tip, and then replacing the holder back in the butt. This gets to be cumbersome during a game as most players prefer to hold the stick in one position during the course of play, while chalking quickly between shots. Additionally, many players use custom made cue sticks which are regarded almost as works of art. To these purists, placing this device on the end of their cues would be almost sacrilegious.

U.S. Pat. No. 3,563,543 to Hamilton et. al. discloses a cue guide and hand rest which aids the player in maintaining a good bridge under all conditions. It also guides the inexperienced player by providing a pattern for making a proper bridge on every shot. This device also has two main problems. First, the device cannot be used in extended reach shots, thereby requiring the use of some type of stick mounted bridge in conjunction with it. And, the device still requires the player to form the bridge with his hand.

Finally, U.S. Pat. No. 635,569 discloses a combination cue support and chalk holder. This device uses a ring which is mounted to the top of a hollow sphere to support the cue stick. The player holds the support and uses the ring to guide the cue. Also, the device can hold a block of chalk inside of the hollow sphere, thereby allowing the player convenient access to chalk. This invention has a problem in that the ring is not the optimum means of controlling the cue stick because the travel of the stick is limited to horizontal rotation and it provides little verticle angular displacement for the cue. The height of the device also limits its use in the case of the "over the ball" shot. Further, access to the chalk for replacement is through a small opening thereby making replacement of the chalk difficult.

It is the object of the present invention to create a mechanical bridge that can be used by any level of player. It is also the object of this invention to provide a bridge that can be used on every shot without sacrificing accuracy or control, and without resort to different types of apparatus. Another object of this invention is to provide convenient holder for cue chalk that is simple to use.

BRIEF DESCRIPTION OF THE INVENTION

The present invention is comprised of a base block to which a shaped dowel block has been fastened. The shaped dowel has two main grooves cut at different depths and radii which allow two main angles of attack. A notch is also cut into one end of the dowel which allows for an "over the ball" shot when the invention is placed on end. The main grooves are also provided with felt to reduce sliding friction. The use of grooves provides much greater cue control then the previous designs. The "x" frame and even the rollers provide little cue surface contact. Further, if the cue is angled, this contact area is reduced to a mere edge, making control of the stick difficult at best. This invention provides a large contact area under all shooting angles which virtually eliminates this control problem.

The chalk holder is attached to the end of the device opposite to the notch. In the present invention, the chalk holder is a piece of rubber or soft plastic that is attached to the device. Two methods of chalk removal are contemplated. First, the length of the holder is such that a portion of the chalk protrudes from the holder. When the chalk needs to be replaced, the player simply holds the protruding edge of the chalk and removes it. The second method is to provide a hole, drilled on angle, through tne base block through which a finger or other similar object can push the chalk from the holder.

BRIEF DESCRIPTION OF THE DRAWINGS

FIG. 1 is an side view of the preferred embodiment.

FIG. 2 is an end view of the preferred embodiment showing the notch portion.

FIG. 3 shows the other end view of the preferred embodiment, detailing the chalk holder portion.

FIG. 4 is a detail of the dowel portion showing the preferred groove construction.

FIG. 5 is a top view of the dowel portion detailing the preferred groove construction.

DESCRIPTION OF THE PREFERRED EMBODIMENT

Referring now to the drawings, and more particularly, FIG. 1, the the mechanical bridge 1 is comprised of a support block 2 of suitable size to provide adaquate support of the cue stick without tipping. In the preferred embodiment, the dimentions of the support block 2 are: 2" long, 1" wide, and $\frac{3}{4}$" thick. A bridge portion 3 is glued or otherwise attached to the support block 2. In the preferred embodiment, the bridge portion 3 is fashioned from one-half of a $1\frac{1}{2}$" diameter wooden dowel that is 2" long. Two grooves are cut into the dowel. The grooves are designed to have two different depths to allow different shooting angles. In the preferred embodiment, one groove 4 is cut $\frac{3}{8}$" deep, and the other groove 5 is $\frac{1}{8}$" deep. A notch 6 is also provided on one end of the bridge portion 3 that provides support for the cue stick when the bridge 1 is used in the verticle position. In the preferred embodiment, the notch is cut 1/16" deep.

The preferred embodiment also includes a chalk holder 7 which is made from rubber or other similar flexible material. The chalk holder 7 is cylindrical, and $1\frac{1}{2}$" in diameter. Two different methods of removing the chalk are contemplated. First, the chalk holder 7 is designed to allow a small portion of the chalk (not shown) to protrude from the chalk holder. This allows the user to grasp the end of the chalk and remove it. The second method is to provide a hole 8 in the base, angled to contact the chalk holder. The user is then able to push the chalk out with a finger or other object.

The invention can also be made from a single piece of wood which is carved into the proper form. All other aspects of the invention are the same as before. The preferred embodiment uses two pieces of wood due to the ease of manufacture. While forming the device from one piece of material, the actual tools needed for the preferred embodiment are much more readily available.

While the preferred embodiment is made of wood, other materials could be used also. Hard plastics or light metals could be substituted for wood without changing the basic design of the device. Felt would have to be installed over the device to reduce friction when using these other materials.

USE OF THE INVENTION

Unlike most mechanical devices, this invention is used for every shot of the game. The player simply places the device on the table and places the cue stick in the desired groove for the shot. Since the base of the device is large enough to provide firm support, the player doesn't have to hold the device to the table. Thus, he is free to place the device anywhere on the table as necessary. Should the player need to raise the cue over a ball on a particular shot, the device can be stood on end, with the cue rested in the notch provided on the end opposite from the chalk holder.

I claim:

1. A mechanical Bridge and chalk holder comprising:

(a) A support block;

(b) A bridge portion, fixedly attached to said support block, having at least one groove transversely placed therein said groove having a generally curved shape and being sized to support an average cue stick;

(c) A cylindrical flexible tube portion, fixedly attached to one end of said support block-bridge portion combination for the purpose of storing cue chalk.

2. The mechanical bridge as described in claim 1 also having an access hole angularly placed through the support block, thereby allowing an object to push a piece of chalk from the said cylindrical flexible tube portion.

3. The mechanical bridge and chalk holder as described in claim 1 wherein the grooves are lined with felt strips.

4. A mechanical bridge and chalk holder comprising:

(a) A support block;

(b) A bridge portion, having two ends disposed longitudinally, being fixedly attached to said support block, having a first groove transversely placed therein having a $\frac{1}{2}$ inch depth, and a second groove also transversely placed therein having a depth of $\frac{1}{8}$ inches;

(c) A third support notch, having a depth of 1/16th inches placed longitudinally on one end of said bridge portion;

(d) A cylindrical, flexible portion fixedly attached to the other end of said bridge portion.

5. The mechanical bridge and chalk holder as described in claim 4 wherein the grooves are lined with felt strips.

6. A mechanical bridge comprising:

(a) a block portion, having a first end and a second end a front surface and a rear surface generally perpendicular to said ends, the block portion having a generally rectangular base with uniform thickness, said block portion also having an integral upper mass that is generally curved in shape from said front surface to said rear surface, said upper mass portion also having at least one groove transversly disposed therein; said mechanical bridge also having a notch, cut into the upper mass portion at the second end of the block portion.

7. The mechanical bridge as described in claim 6 further comprising: a flexible cylindrical portion fixedly attached to the first end of the block portion.

8. The mechanical bridge and chalk holder as described in claim 6 wherein the grooves are lined with felt strips.

* * * * *